United States Patent [19]

Varon

[11] 4,042,995

[45] Aug. 23, 1977

[54] TOOL FOR REMOVING ANIMAL HAIR FROM CARPETING

[76] Inventor: Hyman Varon, 136 E. 76th St., New York, N.Y. 10021

[21] Appl. No.: 688,958

[22] Filed: May 24, 1976

[51] Int. Cl.[2] ..... A47L 13/00

[52] U.S. Cl. ..... 15/142; 15/159 A; 15/40 Z

[58] Field of Search ..... 15/159 A, 142, 180, 15/186, 187, 188, 397, 402; 56/400.01, 400.16, 400.17; D8/13

[56] References Cited

U.S. PATENT DOCUMENTS

| | | | |
|---|---|---|---|
| 2,100,138 | 11/1937 | Heldt | 15/159 A |
| 2,842,789 | 7/1958 | Wells | 15/188 X |
| 3,538,533 | 11/1970 | Woods | 15/142 X |
| 3,744,082 | 7/1973 | Marshall | 15/142 X |
| 3,766,588 | 10/1973 | Kopecky | 15/142 |

FOREIGN PATENT DOCUMENTS

| | | | |
|---|---|---|---|
| 950,461 | 10/1956 | Germany | 15/187 |

*Primary Examiner*—Christopher K. Moore
*Attorney, Agent, or Firm*—McAulay, Fields, Fisher & Goldstein

[57] ABSTRACT

A field of smooth tapered polyethylene bristles extends down from a head attached to a broom handle. The bristles are pulled through carpeting to pick up animal hair. The density of bristles at the trailing edge is greater than elsewhere. The bristles are arranged in a saw-tooth leading edge pattern.

10 Claims, 3 Drawing Figures

TOOL FOR REMOVING ANIMAL HAIR FROM CARPETING

BACKGROUND OF THE INVENTION

The invention is in a tool for the efficient removal of animal hairs from carpeting.

The hairs of domestic animals and particularly dogs and cats have long posed a problem for their owners who have rugs and carpets in their home and in the rooms in which the animals are allowed. Vacuum cleaners are commonly used, of course, but adherence between the animal hairs and the carpeting is such that the vacuum cleaner has to be taken over the same area time and time again to effect any sort of thorough removal of the animal hairs. And, at that, the neck of the hose tends to collect the hairs and the vacuum cleaner has to be shut down and the hose cleaned out periodically. A carpet sweeper is frequently useful but the carpet sweeper brush has to be cleaned out regularly and this is a messy chore. Perhaps more importantly, the hair tends to clog around the axis of the wheels of the carpet sweeper requiring a difficult, messy, and time consuming cleaning out of the sweeper. Industrial grade vacuum cleaners are helpful in situations but these are impractical for the home and their use is clearly an inefficient approach to the cleaning problem involved.

Accordingly, it is a major purpose of this invention to provide a cleaning tool that both quickly and thoroughly removes animal hairs from carpet materials.

It is a further purpose of this invention that this cleaning tool be simple to clean out so that the user has not simply transferred the problem of spending a great deal of time and effort on cleaning off the run to a great deal of time and effort to cleaning out the cleaning tool.

It is a further purpose of this invention that the cleaning tool be simple and inexpensive in design so that excessive costs are avoided.

It is a further purpose of this invention that the cleaning tool act efficiently so that with a minimum of effort and a minimum of going over the same area, a thorough removal job can be achieved.

It is a further purpose of this invention to provide a simple sturdy tool that will avoid the need for parts replacement or repair so that the convenience it provides will not be offset by tool maintenance problems.

BRIEF DESCRIPTION

In brief, one embodiment of this invention employs a broom like structure having a long handle and a head from which depend a field of smooth tapered resilient polyethylene bristles arranged in a number of longitudinal rows across the head. This cleaning tool is designed to be pulled through the carpeting. When so pulled, the bristles dig into the carpeting picking up the animal hairs. Most of the bristles are spaced at about a fifty percent density. But there are a few rows of bristles which are both staggered and much more densely spaced along the trailing edge of the rectangular head. In this fashion, the back rows of bristles trap those hairs which are passed back through the forward bristles during use. The bristles are gradually shortened from back to front so that the head is tilted downward at its front or leading edge thereby facilitating the pulling of the tool through the carpeting.

The front few rows of bristles are spaced and deployed so that most of the hairs picked up are held by the central and rearward teeth of the tool to provide a somewhat even retention of hairs across the field of bristles. Thus the tool does not have to be cleaned out as frequently as otherwise might be the case. The bristles in the first few rows are arranged to present a saw tooth forwardly facing overall configuration. This means that the front most bristles are each at the apex of a small triangle of bristles thereby providing a series of wedges which aid in passing through the nap of the carpet. These features are particularly important where the carpet has a deep nap. That is just the situation where it is most difficult to remove the animal hairs.

DESCRIPTION OF THE PREFERRED EMBODIMENTS

Figure 2:
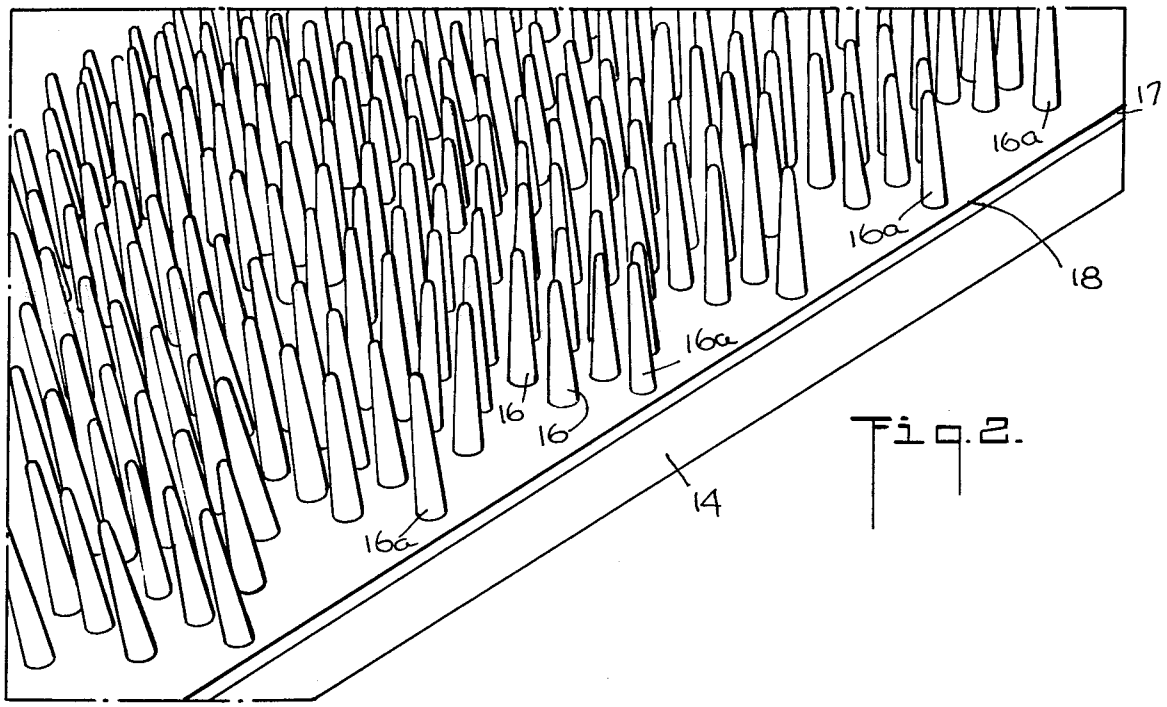
FIG. 2 is a side edge view of the FIG. 1 embodiment.

With reference to the FIGS., all of which illustrate the same embodiment, there is shown a cleaning tool 10 having a handle 12 and a head 14. A field of smooth tapered bristles 16 extend down from a snap-on back plate 17 in the head 14 and, as shown in FIG. 1, the ends of the bulk of the bristles define a plane X—X which can be considered the surface on which the bristle ends rest.

In one embodiment that has been built and tested, the bristles form a field of 12 rows. The tool is pulled through the carpeting so that it has a leading edge 18 and a trailing edge 20. The bristles 16 in a zone along the trailing edge 20 are substantially more densely packed than are the rest of the bristles. Density in this trailing zone of bristles is approximately twice that in the rest of the field of bristles.

Figure 1:
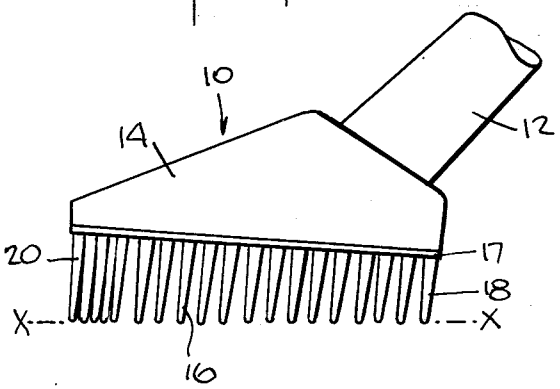
FIG. 1 is a perspective view of the cleaning tool as viewed from the bottom of the cleaning tool showing the field of bristles which extend down from a backboard.
Figure 3:
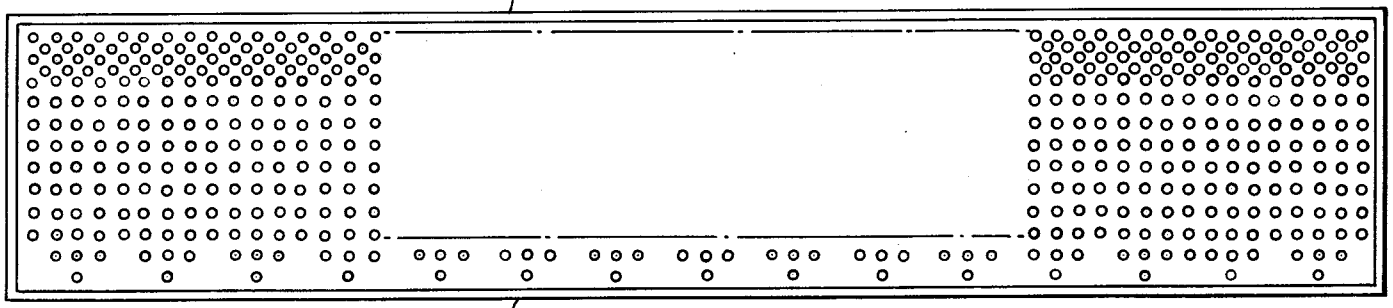
FIG. 3 is a face view, in somewhat schematic form, illustrating the density of bristles.

As may best be seen in FIG. 1, apart from the first few rows of bristles near the leading edge 18, the rest of the bristles 16 are graduated in size in a regular, even fashion so that the tool tends to tilt forward thereby facilitating pulling the tool 10 through the carpeting material. Because of this tilt, each bristle projects into the pile of the carpeting at a slightly rearward going angle and thus avoids getting caught in any loops of the carpeting material. The embodiment that has been tested tilts at an angle of 7° so that the angle between the axis of each bristle 16 and a vertical is also 7°.

Along the leading edge 18, bristles are configured to provide a saw tooth type of leading edge envelope for the bristles themselves. Bristles **16*a*** along the first or most leading row of brisltes are thus relatively widely spaced from each other and form the apex of each triangular section of the saw tooth configuration. Each of these triangular sections provides a wedge for assisting in getting into and through the carpeting material and are particularly useful where the pile is fairly deep.

In one embodiment that has been built and tested, the material out of which the bristles 16 are made is polyethylene. A plastic material such as this is preferred for a number of reasons. First, it can readily be molded so that the entire field of bristles including the plate 17 to which they are attached can be molded as a piece. Second, they provide a smooth surface which facilitates cleaning the hairs off the bristles. Third, an electrostatic charge is developed between the bristles and the hair from the carpet so that the hair tends to be held onto the bristles in part by electrostatic attraction. This is part of the reason why the tool is effective to hold hairs that are not initially wrapped around the bristles. This electrostatic attraction aids in making sure that the tool does not simply rake the hairs from place to place.

In one embodiment that has been built, the surface to which the bristles are molded is a flat plate 17 of polyethylene and this plate 17 together with the bristles 16 are snapped into a polystyrene head 14.

In the embodiment that has been tested, the bristles 16 are ½ inch long at the leading edge 18 and increase in length to three-fourths of an inch at the trailing edge 20. All the bristles 16 are tapered. The bristles are 0.08 inches thick at their base and taper to about 0.025 inches thick near their end. The density of the bristles in that embodiment is three-sixteenths of an inch center to center in the first 10 rows so that there are 36 bristles per square inch along the center zone of the tool. However in the denser longitudinal zone near the trailing edge, there are 56 bristles per square inch. The length of the head is approximately 11 inches and its width approximately 2 inches. Being relatively thin long spikes of polyethylene, the bristles are quite flexible and really deflect. However they are resilient and readily return to their original position.

What is claimed is:

1. A tool for removing animal hairs from carpet material comprising:

a head having a backboard, said head having a leading edge and a trailing edge, and a field of bristles depending from said head, a zone of said bristles along said trailing edge of said head being substantially more densely packed than the rest of said bristles in said field, the ones of said bristles in a predetermined zone adjacent the leading edge of said head arranged such that the leading edge of said bristles has a saw tooth configuration, each of the bristles in the forwardmost row of bristles being substantially spaced from one another and defining the apex of a separate triangular wedge-like section of said saw tooth configuration.

2. The tool of claim 1 wherein said bristles are tapered and have a smooth surface.

3. The tool of claim 2 further comprising:

a broom like handle connected to said head and extending upward and forward to facilitate pulling said bristles along a carpet.

4. The tool of claim 1 wherein the length of said bristles increases as a function of distance from said leading edge of said head.

5. The tool of claim 4 wherein said bristles are tapered and have a smooth surface.

6. The tool of claim 5 further comprising:

a broom like handle connected to said head and extending upward and forward to facilitate pulling said bristles along a carpet.

7. A tool for removing animal hairs from carpet material comprising:

a head having a backboard, said head having a leading and a trailing edge, and a field of bristles depending from said head, a zone of said bristles along said trailing edge of said head being substantially more densely packed than the rest of said bristles in said field, the length of said bristles increasing as a function of distance from said leading edge of said head.

8. The tool of claim 7 wherein said bristles are tapered and have a smooth surface.

9. The tool of claim 8 further comprising:

a broom like handle connected to said head and extending upward and forward to facilitate pulling said bristles along a carpet.

10. The tool of claim 7 further comprising:

a broom like handle connected to said head and extending upward and forward to facilitate pulling said bristles along a carpet.

* * * * *